US006139359A

United States Patent [19]

Fuhreck et al.

[11] Patent Number: 6,139,359

[45] Date of Patent: Oct. 31, 2000

[54] CORDLESS SCREWDRIVER AND MULTI-POSITION BATTERY PACK THEREFOR

[75] Inventors: John E. Fuhreck; Joshua M. Beer, both of Racine, Wis.; Robert L. Hartman, Sioux City, Iowa; Dennis A. Nowak, Greendale; John A. Pierman, Kenosha, both of Wis.

[73] Assignee: Snap-on Tools Company, Kenosha, Wis.

[21] Appl. No.: 09/288,159

[22] Filed: Apr. 8, 1999

[51] Int. Cl.[7] ..... H01R 3/00

[52] U.S. Cl. ..... 439/500; 439/349

[58] Field of Search ..... 439/500, 349; 429/96–100; 310/50

[56] References Cited

U.S. PATENT DOCUMENTS

| | | | |
|---|---|---|---|
| 3,876,275 | 4/1975 | Clark | 439/680 |
| 4,347,450 | 8/1982 | Colligan . | |
| 4,448,098 | 5/1984 | Totsu . | |
| 4,751,452 | 6/1988 | Kilmer et al. | 320/2 |
| 5,033,552 | 7/1991 | Hu . | |
| 5,089,738 | 2/1992 | Bergqvist et al. . | |
| 5,200,280 | 4/1993 | Karasa . | |
| 5,213,913 | 5/1993 | Anthony, III et al. . | |
| 5,348,815 | 9/1994 | Barker . | |
| 5,360,073 | 11/1994 | Akazawa . | |
| 5,368,954 | 11/1994 | Bruns | 429/97 |
| 5,445,900 | 8/1995 | Miller, Jr. et al. | 429/1 |
| 5,489,484 | 2/1996 | Wheeler et al. . | |
| 5,525,889 | 6/1996 | Chan et al. . | |
| 5,553,675 | 9/1996 | Pitzen et al. . | |
| 5,620,808 | 4/1997 | Wheeler et al. . | |
| 5,624,000 | 4/1997 | Miller . | |
| 5,671,815 | 9/1997 | Kabatnik et al. . | |
| 5,687,802 | 11/1997 | Spooner et al. . | |
| 5,706,902 | 1/1998 | Eisenhardt . | |
| 5,749,745 | 5/1998 | Flother et al. | 439/349 |
| 5,752,847 | 5/1998 | McCormick | 439/349 |
| 5,765,652 | 6/1998 | Mathis et al. . | |
| 5,769,657 | 6/1998 | Kondo et al. | 439/500 |
| 5,902,080 | 5/1999 | Kopras | 409/182 |

OTHER PUBLICATIONS

Photographs of Skil Super Twist Tool and Batery Pack, No Date.

Photographs of Black & Decker Versa Pak, No Date.

Photographs of Makita Drill and Battery Pack, No Date.

*Primary Examiner*—Neil Abrams
*Assistant Examiner*—Hae Moon Hyeon
*Attorney, Agent, or Firm*—Seyfarth Shaw

[57] ABSTRACT

A battery-powered driver tool has a tool housing with a socket-type coupler which receives a plug-type coupler of a battery pack in any of four different rotational orientations. Four keys on the battery pack are received in four keyways on the tool housing for non-rotatable engagement, the parts being retained by a split snap ring on the battery pack which cams past four cam shoulders on the tool housing, so that the parts automatically snap-engage and disengage in response to a simple push-pull motion. The battery pack includes a plurality of battery cells connected in series between positive and negative terminals which are designed to respectively engage positive and negative terminals on the tool housing in any of the four rotational orientations of the battery pack. The battery pack has a flat base surface, the parts being designed so that the tool/battery pack combination can be stood on the base surface in one rotational orientation of the battery pack.

14 Claims, 6 Drawing Sheets

CORDLESS SCREWDRIVER AND MULTI-POSITION BATTERY PACK THEREFOR

BACKGROUND OF THE INVENTION

The present invention relates to battery-powered tools and, in particular, to battery packs for such tools. The invention has particular application to the coupling between a battery pack and an associated tool housing.

Various types of battery packs for battery-powered tools are known. In one arrangement, a generally cylindrical battery is completely received within the cylindrical handle portion of a tool housing, with the cylindrical wall of the battery forming the negative terminal and there being an axial positive terminal, so that the battery can be received and connected in the tool housing in any rotational orientation.

However, the present invention is directed principally to another type of battery pack which is self-contained and is designed to be attached onto the end of the handle portion of the tool housing so as to form an extension thereof. Such battery packs are typically provided with a latch mechanism to latch the battery pack in place on the tool housing. One such arrangement is disclosed, for example, in U.S. Pat. No. 5,213,913. In order to detach the battery pack from the tool housing, the latch must first be disengaged, typically by laterally depressing latch levers, and then the battery pack can be axially pulled from the handle portion of the tool housing. Such battery packs are typically designed to be mounted in only a single orientation. Because the battery pack is mounted as an extension of the tool housing, it may be difficult to maneuver the tool in constricted areas.

SUMMARY OF THE INVENTION

It is a general object of the invention to provide an improved battery powered tool which avoids the disadvantages of prior tools while affording additional structural and operating advantages.

An important feature of the invention is the provision of a battery-powered tool with an externally-mounted battery pack which can be snap-mounted in place without the use of a separately manipulated latch mechanism.

Another feature of the invention is the provision of a battery-powered tool of the type set forth, wherein the battery pack can be mounted in any of a number of different orientations without affecting electrical contact with the motor.

A still further feature of the invention is the provision of a battery-powered tool of the type set forth, which is of relatively simple and economical construction.

Certain ones of these and other features of the invention may be attained by providing a battery-powered tool comprising: a tool housing having a first coupling portion, a battery pack housing having a second coupling portion mateably engageable with the first coupling portion for removably mounting the battery pack housing on the tool housing, a first retaining structure on one of said coupling portions, and a second resilient retaining structure on the other of said coupling portions and snap-engageable with said first retaining structure in response to substantially coaxial movement of said first and second coupling portions into engagement with each other for resiliently retaining the first and second coupling portions together in a use condition, said second retaining structure being yieldable in response to substantially coaxial forces applied to said first and second coupling portions in a separating direction while in the use condition to disengage said first and second retaining structures and permit removal of said battery pack housing from the tool housing.

Further features of the invention may be attained by providing a battery-powered tool of the type described, wherein at least one coupling structure on one of the housings is engageable with any of a plurality of coupling structures on the other housing to permit mounting of the battery pack in a use condition in any of a plurality of rotational orientations, each of the housings having positive and negative terminals which are electrically connectable with each other in any of the rotational orientations.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
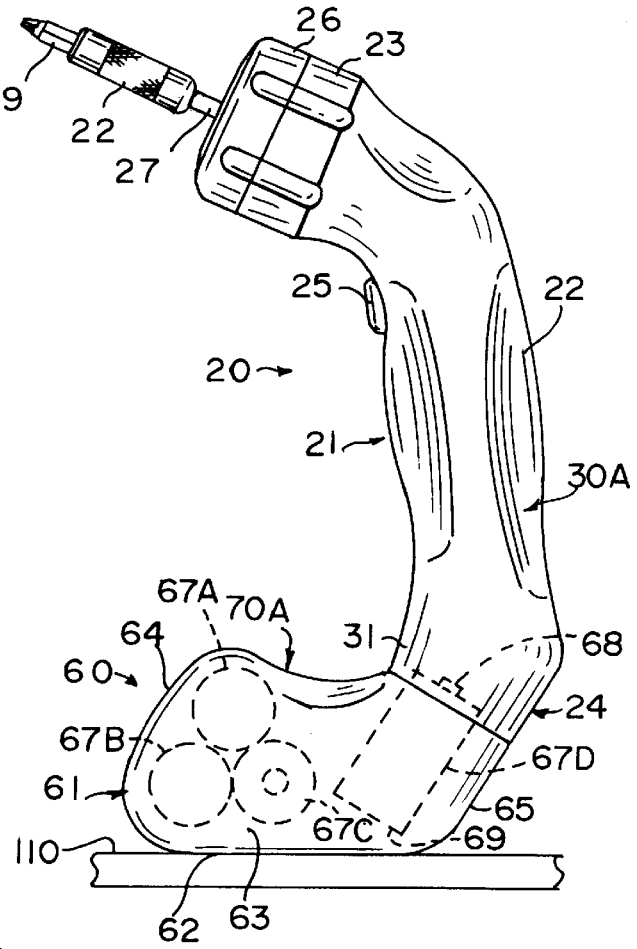
FIG. 1 is a side elevational view of a battery-powered tool/battery pack combination in accordance with the present invention, shown resting on a support surface.

Referring to FIG. 1, there is illustrated a cordless power tool, generally designated by the numeral 20, in the nature of battery-powered driver tool. The tool 20 has an elongated housing 21, preferably of two-part construction, including left-hand and right-hand housing halves 30A and 30B secured together, as by screws. The housing 21 has an elongated central handle portion 22, unitary at its opposite ends respectively with substantially cylindrical front and rear coupling portions 23 and 24 which, respectively, have cylindrical axes inclined at first and second obtuse angles with respect to the longitudinal axis of the handle portion 22. A trigger 25 is provided at the front side of the handle portion 22 adjacent to the front coupling portion 23. The front coupling portion 23 houses a ratchet mechanism (not shown) the operating condition of which is controlled by a reversing cap 26 which is mounted for rotation relative to the housing 21. The ratchet mechanism is coupled to a shank 27 provided with a socket 28 for receiving a driver bit 29, such as a screwdriver bit, a nut driver bit or the like. It will be appreciated that there is disposed within the housing 21 a suitable reversible DC electric motor (not shown) powered by a battery contained in a battery pack 60, which is adapted to be removably mounted on the rear coupling portion 24 of the housing 21.

Referring also to FIGS. 6 and 10–13, the two housing halves 30A and 30B are essentially mirror images of each other, and the following description, which is limited to the rear coupling portion 24, will treat it as if it were a one-part housing, unless otherwise indicated. The rear coupling portion 24 has a substantially cylindrical side wall 31 defining a socket and having formed in the inner surface thereof four equiangularly spaced-apart, substantially rectangular keyway recesses 32 extending axially inwardly of the rear coupling portion 24 from the distal end thereof. Also formed on the inner surface of the side wall 31, and circumferentially alternating with the keyway recesses 32, are four retaining cam projections 33 disposed substantially adjacent to the inner ends of the keyway recesses 32 and each being generally V-shaped in radial cross section, each cam projection 33 having outer and inner cam surfaces 34 and 35. Formed at the inner end of the rear coupling portion 24 adjacent to the junction with the handle portion 22 is a septum 36 having a plurality of slots formed therein for supporting an electrical terminal assembly.

Figure 10:
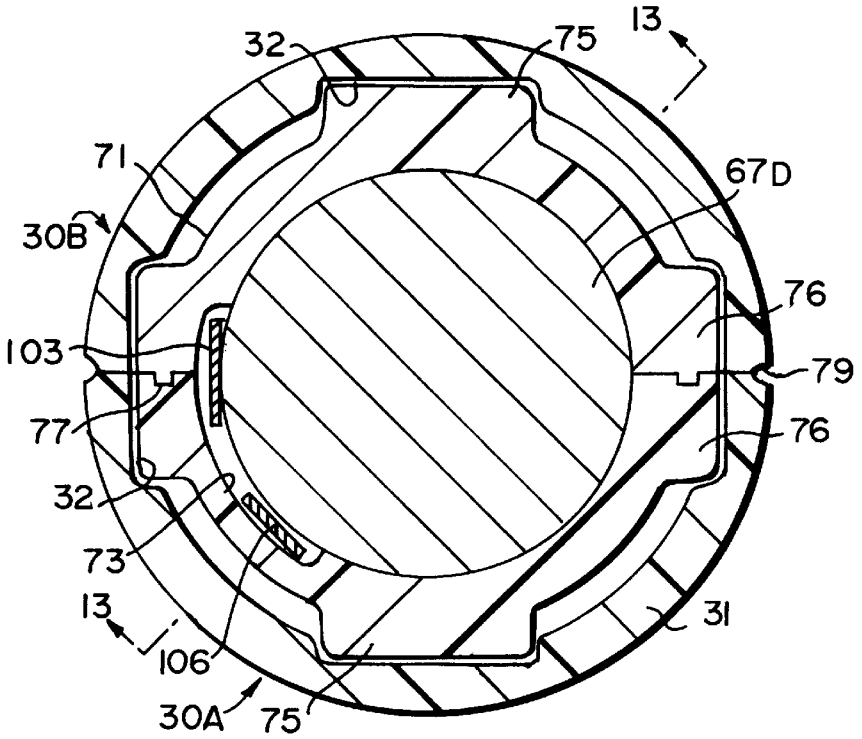
FIG. 10 is a further enlarged, fragmentary, sectional view taken generally along the line 10—10 in FIG. 6.

More specifically, there is provided an elongated, negative terminal member 40 formed of a suitable metal and having an inner end 41 adapted to be coupled, as by soldering, to a terminal conductor of the DC motor. The end 41 is integral with a flat body portion 42 having a pair of upstanding tangs or flanges 42*a* to facilitate mounting in the septum 36. The terminal member 40 has a series of angled leg portions including a leg 43, a leg 44 and a recurved contact tip portion 45 including a leg 46 joined at a bearing elbow 47 to a leg 48 which is, in turn, integral with an end leg 49 (FIG. 10).

The housing 21 also has a positive terminal assembly 50 including a bracket 51 having laterally extending legs 52 (one shown) respectively trapped in slots in the septum 36, one of the legs 52 being integral with an end tab 54 adapted to be connected, as by soldering, to another terminal lead wire of the DC motor. The positive terminal assembly 50 also includes a generally bullet-shaped plug 55 having a cylindrical side wall and a blunt rounded end wall and unitary at one end with a cylindrical neck 56, which extends through an aperture in the bracket 51 and is peened over for firm mechanical and electrical contact therewith (see FIG. 13). The plug 55 is positioned so as to be substantially coaxial with the cylindrical side wall 31 of the rear coupling portion 24.

Referring now to FIGS. 7–9 and 11–13, the battery pack 60 has a housing 61 with a flat, substantially planar base wall 62, a pair of substantially parallel side walls 63 perpendicular to the plane of the base wall 62, a front wall 64 and a rear wall 65. The housing 61 also has a generally cylindrical coupling plug 66 (see FIG. 5) which is adapted to mateably engage in the socket defined by the rear coupling portion 24 of the tool housing 21, as will be explained more fully below. The coupling plug 66 is joined to the housing 61 at an annular shoulder 66*a* which extends radially outwardly from the coupling plug 66. Disposed in the battery pack 60 is a battery, which preferably includes four rechargeable battery cells 67A–D (see FIG. 1), each having positive and negative terminals 68 and 69, respectively at the opposite ends thereof.

Figure 7:
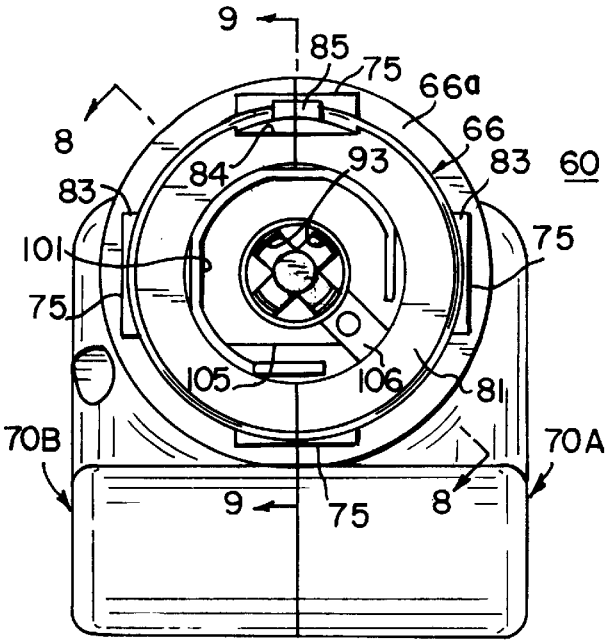
FIG. 7 is a further enlarged end elevational view of the battery pack taken generally along the 7—7 in FIG. 5.
Figure 8:
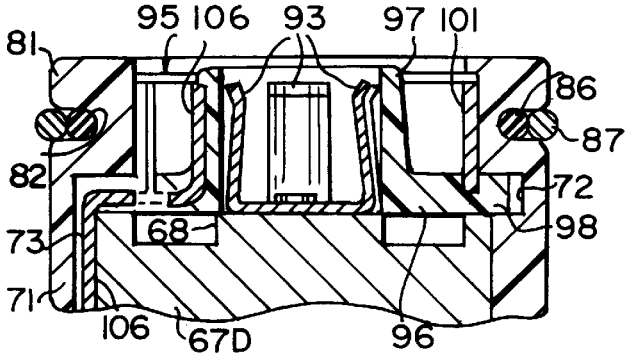
FIG. 8 is a still further enlarged, fragmentary, sectional view taken generally along the line 8—8 in FIG. 7.
Figure 9:
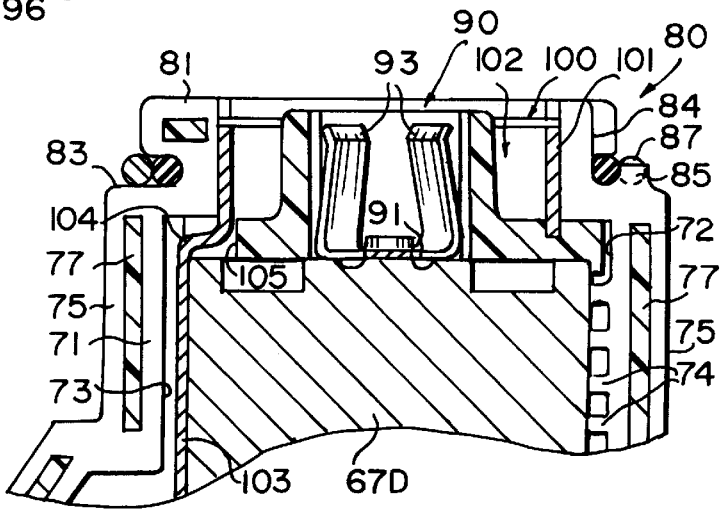
FIG. 9 is a further enlarged, fragmentary, sectional view taken generally along the line 9—9 in FIG. 7.
Figure 12:
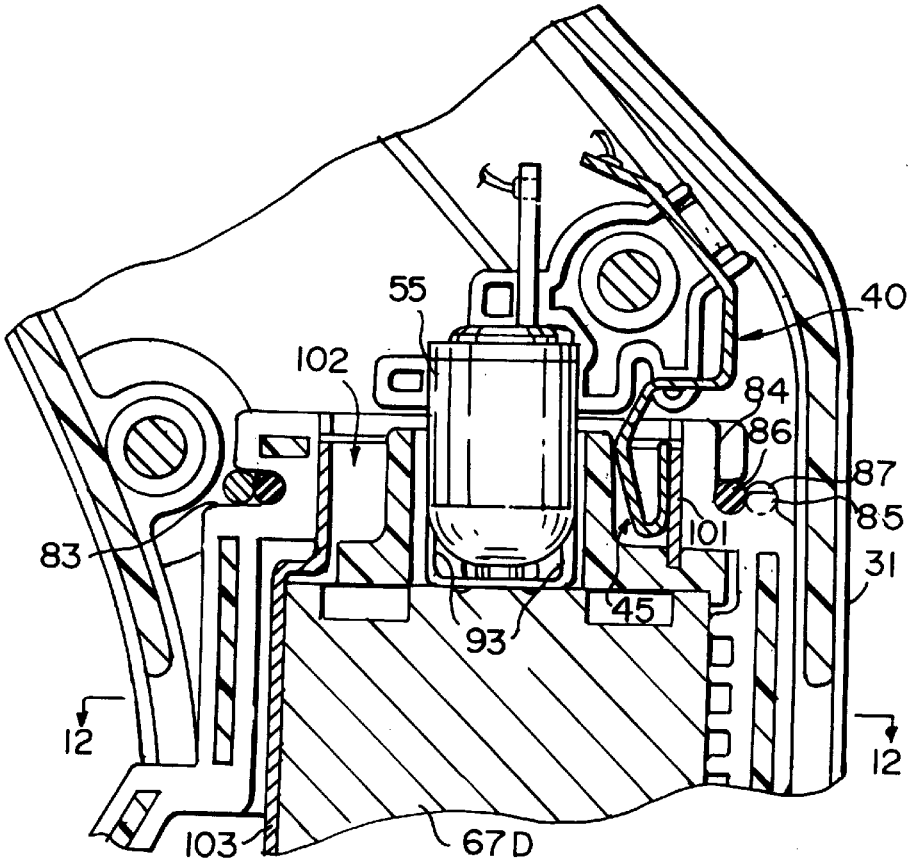
FIG. 12 is a sectional view taken generally along the line 12—12 in FIG. 11.
Figure 13:
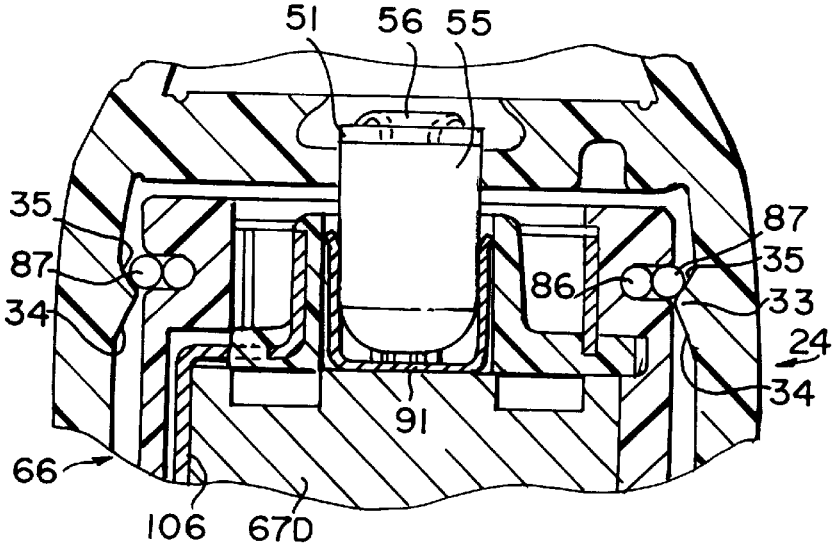
FIG. 13 is a sectional view taken generally along the line 13—13 in FIG. 12.

As is best seen in FIGS. 7 and 12, the battery pack housing 61 is preferably of two-part construction, including left-hand and right-hand halves 70A and 70B, which are essentially mirror images of each other, being secured together, as by screws. The housing 61 will be discussed below essentially as if it were a one-part housing, except where otherwise indicated. The coupling plug 66 has a generally cylindrical wall 71. Formed in the inner surface of the wall 71 is an annular groove 72 (FIGS. 8 and 9). Communicating with the groove 72 and extending axially inwardly therefrom is a recess 73 which has a circumferential extent of approximately 40°. Projecting laterally outwardly from the outer surface of the cylindrical wall 71 are four equiangularly spaced-apart keys 75, which are substantially rectangular in shape and extend axially from the shoulder 66*a* a substantial part of the length of the cylindrical wall 71. Projecting laterally inwardly from the cylindrical wall 71 at the rear end thereof are a plurality of spaced material saving ribs 74 (FIG. 7). Preferably, the peripheral edge of the housing half 70A has a projecting rib or tongue 77 which is received in a complementary groove 79 extending around the peripheral edge of the housing half 70B, as is best seen in FIGS. 9 and 12.

Figure 11:
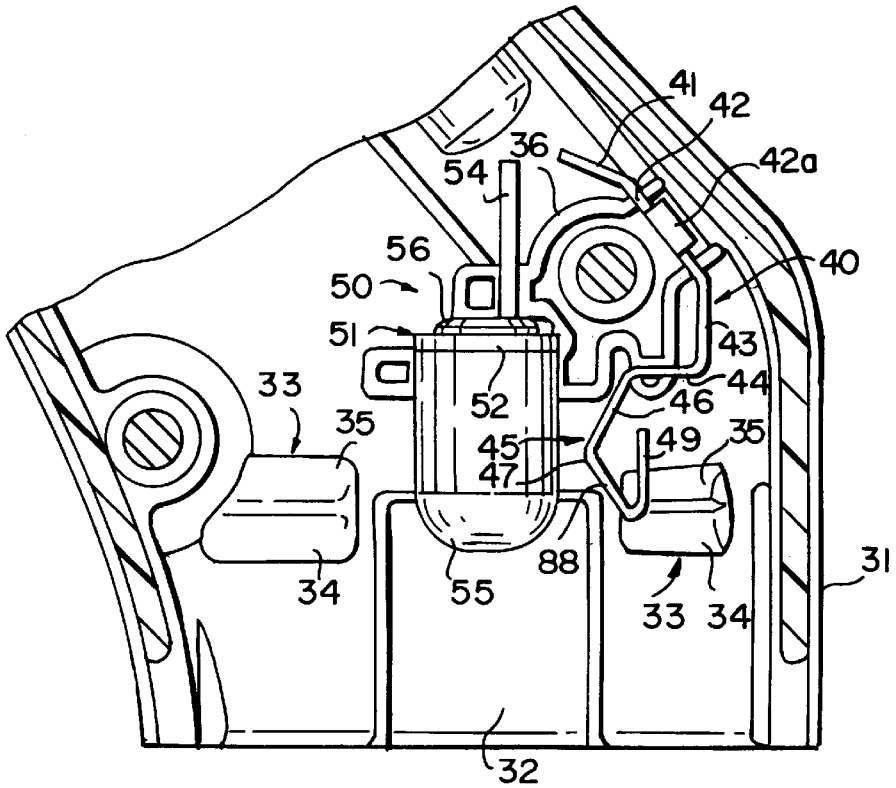
FIG. 11 is a view similar to FIG. 9 of the battery pack engaged with the tool housing.

The coupling plug 66 carries a retaining assembly 80. More specifically, the portion of the cylindrical wall 71 which projects forwardly of the keys 75 defines an annular neck 81, in the outer surface of which is formed an annular groove 82 (FIG. 8). The outer ends of the keys 75 terminate at the groove 82 and define shoulder surfaces 83 (FIGS. 7, 9 and 11). A rectangular notch 84 (FIG. 7) is formed in the outer circumferential surface of the neck 81 substantially coextensive with and axially aligned with one of the key shoulder surfaces 83 to provide access to the groove 82. Projecting forwardly from that shoulder surface 83 is a stop tab 85. A flexible and resilient O-ring 86, formed of an elastomer or rubber, is seated in the groove 82. Also disposed in the groove 82 and overlying the O-ring 86 is a split snap-ring 87, preferably formed of a suitable metal. The ends of the snap-ring 87 are disposed for abutting engagement with the stop tab 85 (FIG. 7) to inhibit rotational movement of the snap-ring 87.

The battery pack 60 has a positive terminal 90 with a base 91 (FIGS. 9 and 13), mechanically and electrically connected to the anode of the battery cell 67D by suitable means, and four flexible and resilient upstanding contact arms 93 which are equiangularly spaced apart. The contact arms 93 have a normal rest position, wherein the distal ends thereof are substantially tangent to an imaginary circle which has a diameter slightly less than the diameter of the positive terminal plug 55 on the tool housing 21. Thus, it will be appreciated that the positive terminal 90 essentially defines a resilient socket, the arms 93 of which are spread by insertion of the plug 55 to resiliently grip the plug 55 for electrical contact therewith.

The battery pack 60 also has a negative terminal assembly 95 which includes a plastic molding 96, having a cylindrical collar 97 integral at its inner end with a radially outwardly extending annular flange 98, which is seated in the groove 72 in the cylindrical wall 71 (see FIGS. 8 and 9). A negative terminal 100, formed of a suitable metal, has a generally part-cylindrical wall 101 coaxially encircling the molding collar 97 and spaced radially outwardly therefrom for cooperation therewith to define an annular space 102 therebetween. Preferably, the inner edge of the part-cylindrical wall 101 is embedded in an annular groove in the upper surface of the molding flange 98. The negative terminal 100 has an elongated depending leg 103, which is joined to the part-cylindrical wall 101 by a knee 104 which extends through a gap 105 in the molding 96. The leg 103 extends downwardly along the outside of the battery cell 67D, being accommodated in the recess 73 in the cylindrical wall 71 (see FIG. 12).

The negative terminal assembly 95 also includes a charging contact strip 106, which is insert molded in the molding 96 and also extends downwardly along the outside of the battery cell 67D in the recess 73 at the location of the opening in the part-cylindrical wall 101. Preferably, a thermistor (not shown) is disposed in the battery pack housing 61 and has terminals respectively connected to the negative terminal leg 103 and the charging contact strip 106. The battery pack 60 is adapted to be coupled to a battery charger, which will include a temperature monitor circuit connected between the negative terminal leg 103 and the charging contact strip 106 for sensing the output of the thermistor to monitor the temperature in the battery pack 60 during charging. In this regard, it will be appreciated that the rechargeable battery cells 67A–67D can become quite hot during charging.

It will be appreciated that the battery cells 67A–67D are connected in series between the positive terminal 90 and the negative terminal 100 by a plurality of suitable conductors (not shown). When the coupling plug 66 of the battery pack 60 is plugged into the rear coupling portion 24 of the tool housing 21, as illustrated in FIGS. 1, 5 and 11–13, the positive and negative terminals 90 and 100 of the battery pack 60 will, respectively, electrically contact the positive and negative terminals 50 and 40 of the tool housing 21 for connecting the battery cells 67A–D in series across the terminals of the DC motor, preferably through an ON-OFF switch actuated by the trigger 25 and suitable direction control switches (not shown), all in a known manner. A preferred form of direction control circuitry is disclosed in copending application Ser. No. 09/347,720, filed Jul. 6, 1999 and entitled "Electric Ratcheting Screwdriver with Synchronized Motor and Ratchet Direction Control."

Figure 2:
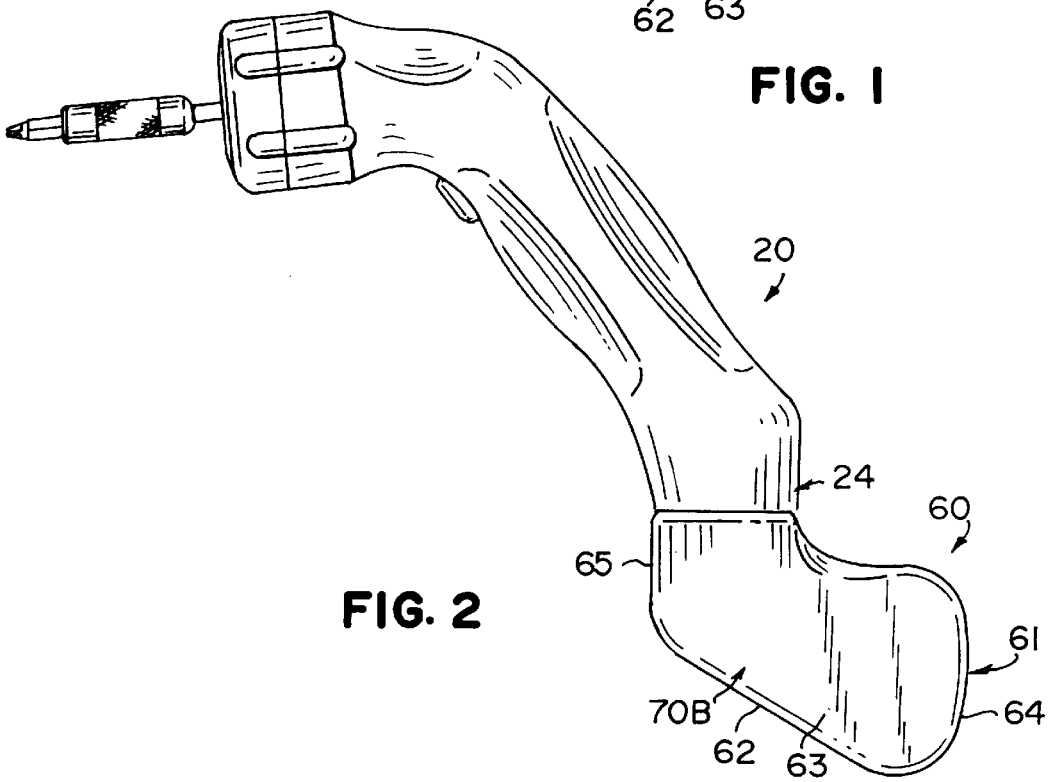
FIG. 2 is a view similar to FIG. 1, but with the support surface removed and with the battery pack rotated 180°.
Figure 3:
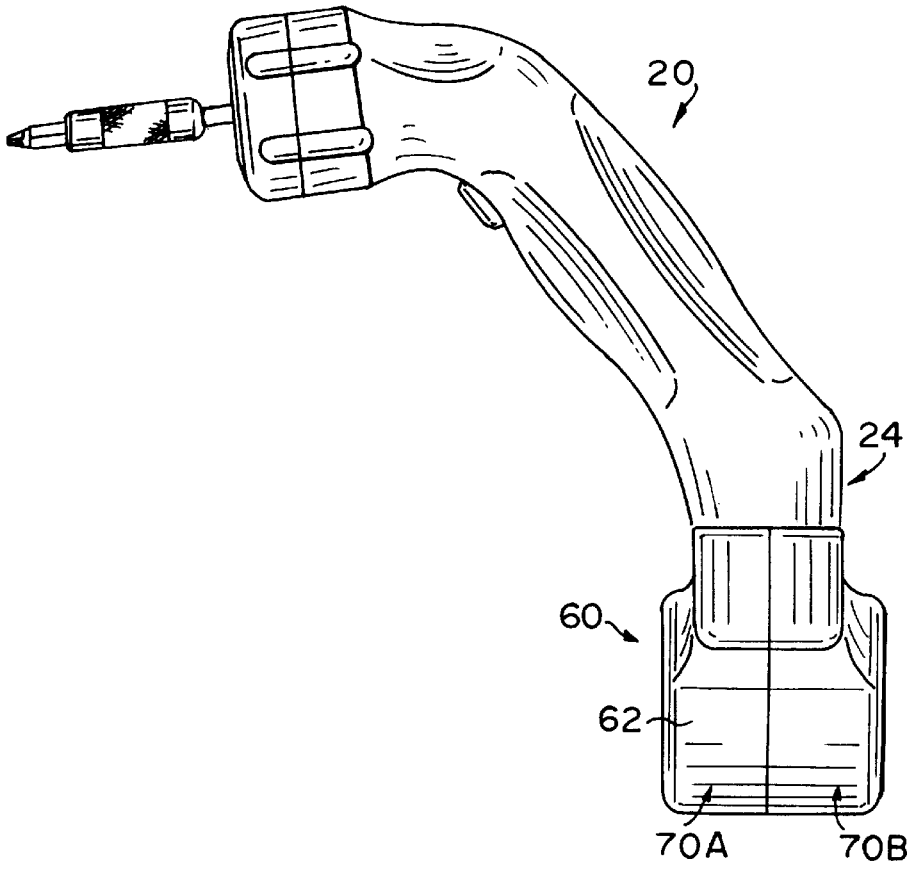
FIG. 3 is a view similar to FIG. 2, with the battery pack rotated 90° into the plane of the paper.
Figure 4:
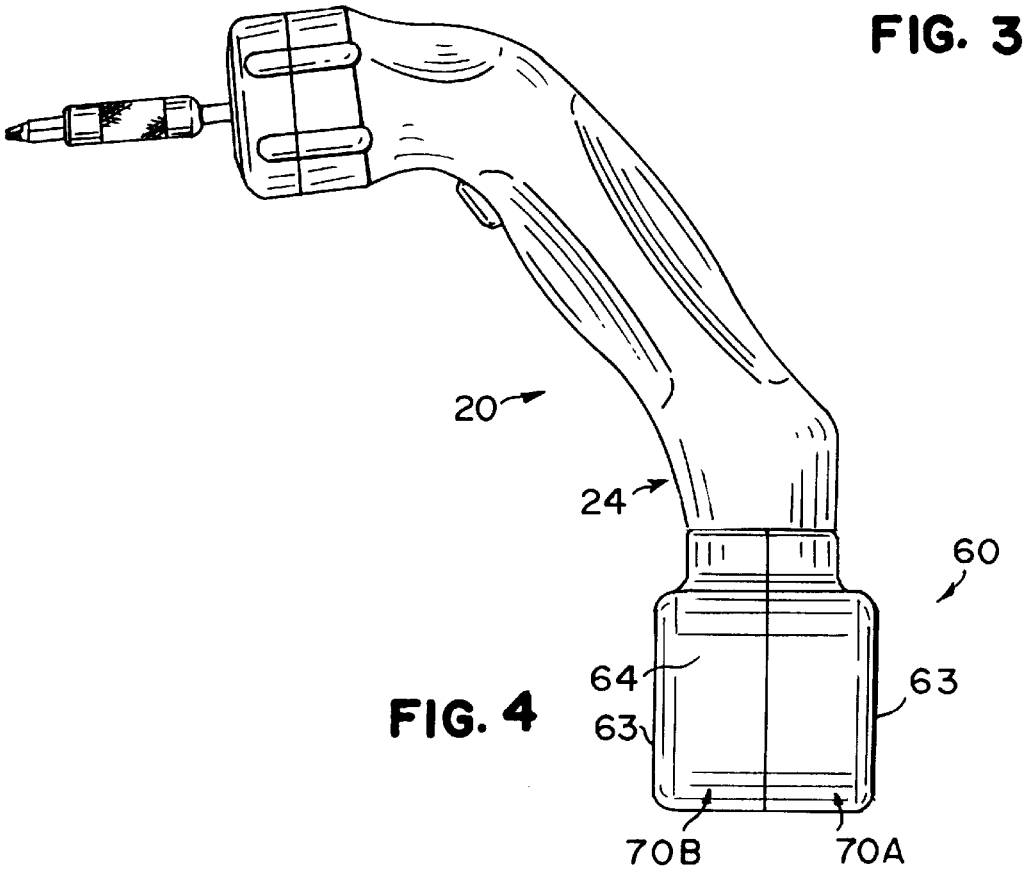
FIG. 4 is a view similar to FIG. 2 with the battery pack rotated 90° out of the plane of the paper.

An important feature of the invention is that the battery pack 60 can be non-rotatably coupled to the tool housing 21 in any of four different rotational orientations, illustrated respectively, in FIGS. 1–4. More specifically, the battery pack 60 can project from the tool housing 21 forwardly in the direction of the shank 27, as illustrated in FIG. 1, rearwardly, as illustrated in FIG. 2, or to either side, as illustrated in FIGS. 3 and 4. This greatly facilitates use of the tool 20 in constricted locations since, if the battery pack 60 interferes with operation in one orientation, it can be shifted to a different orientation which may present less interference. It will be appreciated that these four rotational orientations of the battery pack 60 are defined by the positions of the keys 75 on the battery pack 60 and the keyway recesses 32 in the tool housing 21. Thus, referring in particular to FIGS. 5 and 11–13, when the coupling plug 66 of the battery pack 60 is inserted into the rear coupling portion 24 of the tool housing 21, the keys 75 are respectively received in the keyway recesses 32 and, since the keys 75 and the keyway recesses are identically sized and shaped and equiangularly spaced, any of the keys 75 is receivable in any of the keyway recesses 32. Once engaged, this keyed arrangement prevents rotation of the battery pack 60 relative to the tool housing 21.

Another important aspect of the invention is the retention of the battery pack 60 in the tool housing 21 without the use of a separately actuatable latch mechanism. In this regard, the retention assembly 80 automatically provides for resilient retention of the coupling plug 66 in the rear coupling portion 24 and release of the coupling plug 66 from the rear coupling portion 24, simply in response to axial push-pull movements. More specifically, referring to FIG. 13, when the coupling plug 66 is inserted into the rear coupling portion 24 the split snap-ring 87 will engage the outer cam surfaces 34 of the cam projections 33, the resilient O-ring 86 accommodating radially inward compression of the snap-ring 87 to permit it to cam past the retaining cam projections 33 in a frictional snap action to bring the parts to the use condition illustrated in FIG. 13. In this condition, the slit snap-ring 87 has sprung back to engage the inner cam surfaces 35 of the cam projections 33 to resiliently retain the coupling plug 66 in place and prevent its accidental disengagement. In order to remove the battery pack 60, a firm axially outward pulling force on the batter pack 60 will cam the split snap-ring 87 past the cam projections 33.

It will be appreciated that the notch 84 in the neck 81 facilitates mounting of the O-ring 86 and the snap-ring 87 in place in the neck groove 82 and removal of same for opening the battery pack 60. Also, because the retaining cam projections 33 are disposed between the keyway recesses 32, and because the snap-ring 87 is retained against rotation by the stop tab 85 (FIG. 7) so that the gap in the split snap-ring 87 is positioned at a key 75, engagement of the snap-ring 87 with the retaining cam projections 33 is ensured in each of the four mounting positions of the battery pack 60.

Figure 5:
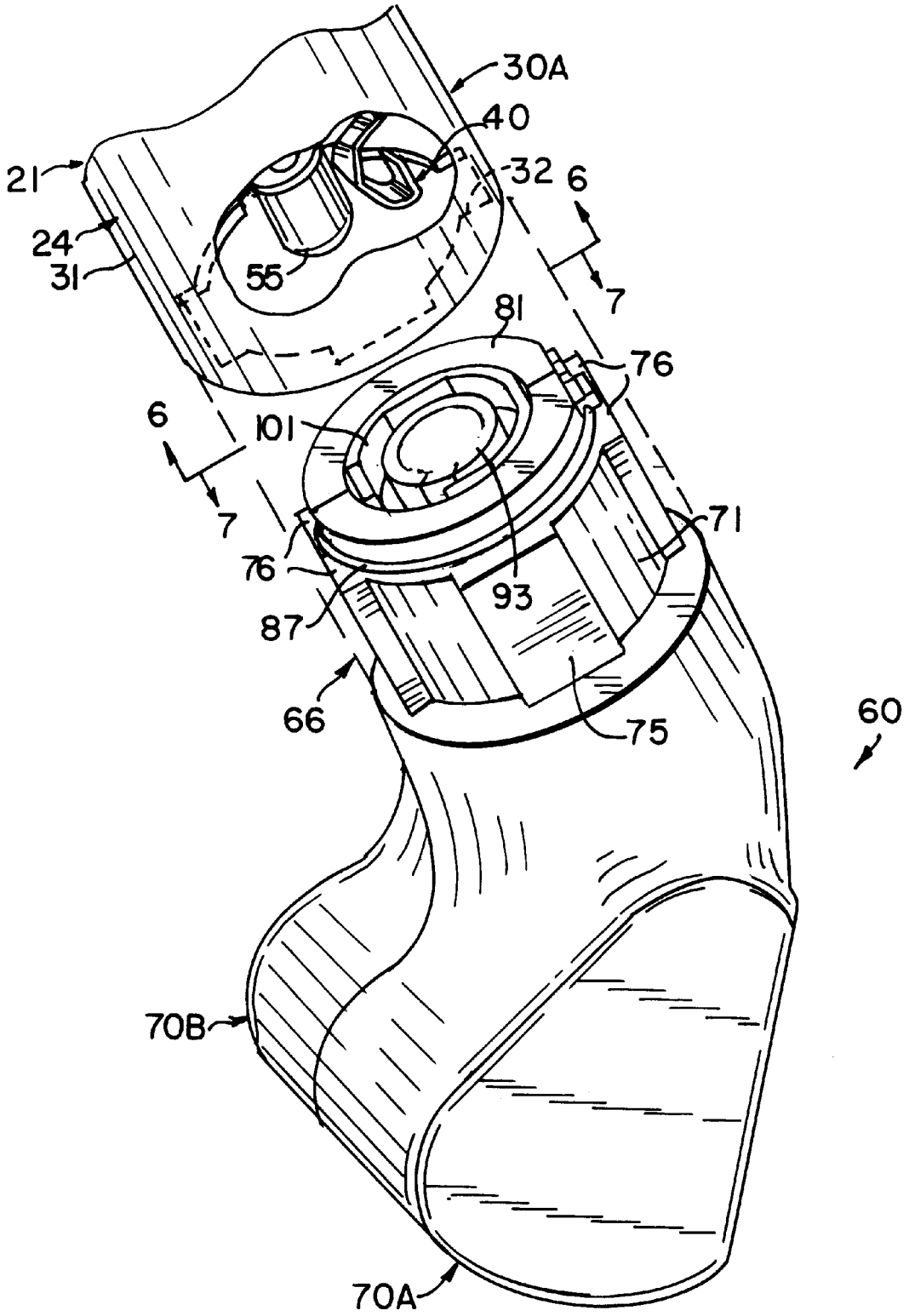
FIG. 5 is an enlarged, fragmentary, perspective view of the battery pack of FIG. 1 detached from the coupling portion of the tool housing.
Figure 6:
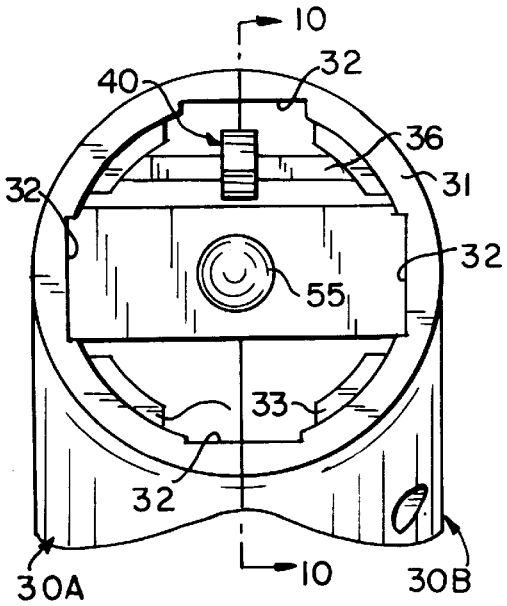
FIG. 6 is a further enlarged, fragmentary, end elevational view of the tool housing taken generally along the line 6—6 in FIG. 5.

Another aspect of the invention is that the electrical terminals are so arranged that good electrical contact between the battery pack 60 and the tool housing 21 is ensured in each rotational mounting orientation of the battery pack 60. Thus, the positive terminals are positioned axially so as to be unaffected by rotational position, the cylindrical shape of the plug 55 and the equiangularly spaced contact arms 93 of the positive terminal 90 ensuring good plug-and-socket resilient connection of the plug 55 in the positive terminal 90 in any position. When the battery pack 60 is mounted in its use condition on the tool housing 21, the contact tip 45 of the negative terminal member 40 is resiliently received in the annular space 102 between the part-cylindrical wall 101 of the negative terminal 100 and the molding collar 97, as is best illustrated in FIGS. 5 and 11. In this regard, the contact tip 45 preferably has an at-rest radial width slightly greater than the radial width of the annular space 102 so that, upon insertion, the contact tip 45 is slightly radially compressed to ensure good electrical contact of the end leg 49 with the part-cylindrical wall 101 of the negative terminal 100. It will be noted that the negative terminal member 40 of the tool housing 21 is radially aligned in the center of one of the keyway recesses 32 (see FIG. 6), while the opening in the part-cylindrical wall 101 of the negative terminal 100 is positioned between keys 75 (see FIG. 7), so that the negative terminal member 40 can never be disposed at the opening in the part-cylindrical wall in any of the four rotational mounting positions of the battery pack 60.

Another aspect of the invention is that the battery pack 60 is so designed that, when it is mounted in the forward-projecting orientation illustrated in FIG. 1, the large base wall 62 provides a support wall which can be rested on an underlying support surface 110, such as a table, bench or the like. In this mounting position the base wall 62 is disposed beneath the center of gravity of the tool/battery pack combination to support the tool/battery pack combination in an upright position.

From the foregoing, it can be seen that there has been provided an improved battery-powered tool and battery pack therefor, wherein the battery pack is mountable in place in a use condition in any of a plurality of different rotational orientations, being resiliently retained in the use condition without a separately-actuatable latch mechanism and so as to ensure good electrical contact between the battery pack and tool housing in any mounting position.

While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A battery-powered tool comprising:

a tool housing having a first coupling portion, a battery pack housing having a second coupling portion mateably engageable with the first coupling portion for removably mounting the battery pack housing on the tool housing, a first retaining structure including a cam shoulder on one of said coupling portions, and a second resilient retaining structure including a split snap ring on the other of said coupling portions resiliently engageable with said cam shoulder for deforming said snap ring and permitting it to snap past said cam shoulder in response to substantially coaxial movement of said first and second coupling portions into engagement with each other for resiliently retaining the first and second coupling portions together in a use condition, said second retaining structure being yieldable in response to substantially coaxial forces applied to said first and second coupling portions in separating directions while in the use condition to disengage said first and second retaining structures and permit removal of said battery pack housing from said tool housing.

2. The tool of claim 1, wherein said first retaining structure is on said first coupling portion and said second retaining structure is on said second coupling portion.

3. The tool of claim 1, wherein said first coupling portion defines a female socket and said second coupling portion defines a male plug.

4. The tool of claim 1, wherein said first retaining structure includes four cam shoulders equiangularly spaced-apart.

5. The tool of claim 1, wherein said second retaining structure includes a resilient O-ring, said snap ring extending about said O-ring substantially coaxially therewith.

6. The tool of claim 1, wherein said second retaining structure includes a stop member engageable with ends of said split ring to inhibit rotational movement thereof and ensure that it engages the cam shoulder.

7. The tool of claim 1, wherein said battery pack housing has a flat base surface, said tool housing and said battery pack housing being shaped so that in the use condition said tool can be stood upright on said base surface in at least one rotational orientation of said battery pack housing.

8. The tool of claim 1, and further comprising first positive and negative terminals on one of said housings and second positive and negative terminals on the other of said housings respectively electrically connectable to said first positive and negative terminals in any rotational orientation of said housings.

9. A battery-powered tool comprising:

a tool housing, a battery pack housing, a first coupling portion including a plurality of first coupling structures on one of said housings, a second coupling portion including at least one second coupling structure on the other of said housings engageable with any of said first coupling structures for removably and non-rotatably mounting the battery pack housing on the tool housing in a use condition in any of a plurality of rotational orientations, first positive and negative terminals on one of said housings, second positive and negative terminals on the other of said housings respectively electrically connectable to said first positive and negative terminals in any of said rotational orientations, a first retaining structure on one of said coupling portions, and a second resilient retaining structure on the other of said coupling portions and snap-engageable with said first retaining structure in response to substantially coaxial movement of said first and second coupling portions into engagement with each other for resiliently retaining the first and second coupling portions together in a use condition, said second retaining structure being yieldable in response to forces applied to said first and second coupling portions substantially parallel to said axis in separating directions while in the use condition to disengage said first and second retaining structures and permit removal of said battery pack housing from said tool housing.

10. The tool of claim 9, wherein said first retaining structure is on said first coupling portion and said second retaining structure is on said second coupling portion.

11. The tool of claim 9, wherein said first retaining structure includes a cam shoulder, said second retaining structure including a snap ring resiliently engageable with said cam shoulder for deforming said snap ring and permitting it to snap past said cam shoulder.

12. The tool of claim 11, wherein said second retaining structure includes a resilient O-ring, said snap ring being a split ring extending about said O-ring substantially coaxially therewith, said second retaining structure including a stop member engageable with ends of said split ring to inhibit rotational movement thereof and ensure that it engages the cam shoulder.

13. The tool of claim 9, wherein said first coupling structures are on said tool housing and respectively define keyways, said battery pack having a plurality of said second coupling structures, said second coupling structures respectively defining keys respectively receivable in said keyways.

14. The tool of claim 13, wherein said first positive terminal is a plug and said second positive terminal defines a socket resiliently engageable with said plug, said second negative terminal including a generally cylindrical wall and said first negative terminal including a leaf spring arm resiliently engageable with said wall.

* * * * *